United States Patent [19]

McKay

[11] Patent Number: 4,580,992

[45] Date of Patent: Apr. 8, 1986

[54] TRANSFORMABLE TOY

[76] Inventor: Robert S. McKay, 7420 Beckwith Rd., Morton Grove, Ill. 60053

[21] Appl. No.: 696,755

[22] Filed: Jan. 31, 1985

[51] Int. Cl.[4] ..... A63H 3/12

[52] U.S. Cl. ..... 446/321; 446/99; 446/339; 446/391

[58] Field of Search ..... 446/99, 100, 98, 321, 446/337, 339, 391, 374, 340

[56] References Cited

U.S. PATENT DOCUMENTS

| | | | |
|---|---|---|---|
| 1,552,348 | 9/1925 | Rosenthal | 446/99 |
| 1,566,801 | 12/1925 | Millard | 446/99 |
| 3,106,041 | 10/1963 | Kahn | 446/100 |
| 3,851,419 | 12/1974 | Kaelin | 446/321 |
| 4,336,665 | 6/1982 | Moreau | 446/321 |

FOREIGN PATENT DOCUMENTS

| | | | |
|---|---|---|---|
| 2013508 | 8/1979 | United Kingdom | 446/99 |

*Primary Examiner*—Robert A. Hafer
*Assistant Examiner*—Daniel Nolan
*Attorney, Agent, or Firm*—Haight, Hofeldt, Davis & Jambor

[57] ABSTRACT

A doll or toy action figure, transformable from a first character, to a second character. A hard molded head has a facial countenance of a character. A flexible latex mask is positioned around the neck and is fixedly attached. The outer surface of the latex mask has facial characteristics of another character. Means are provided for moving the mask from a first position at least partially covering the head and displaying the facial countenance on the mask, to a second position about the neck of the head wherein the facial characteristics of the head are exposed. Articles of clothing may be removed or rearranged to augment the effect.

15 Claims, 8 Drawing Figures

TRANSFORMABLE TOY

BACKGROUND OF THE INVENTION

This invention relates to a child's toy action figure, and more particularly, to a new and novel figure transformable from a first character, to a second character.

With the advent of monster movies and the popularity of television programs featuring supernatural events, it is not unusual for children to play with toys having monster features. Toy action figures are also popular with children. Examples are Barbie Dolls, G. I. Joe dolls, toy soldiers, and the like. (BARBIE DOLL is a trademark of Mattell Inc., G. I. JOE is a trademark of Hasbro, Inc.)

The present invention provides such a toy action figure with a dual personality and captures the interest of the user from both aspects.

SUMMARY OF THE INVENTION

The present invention comprises a new and novel toy action figure which is transformable between a first character, such as a human being, to a second character, such as a monster. The figure or doll includes a body with a head attached to the body. The head is formed with facial features of a character, such as a monster. A flexible mask is positioned about the head and has an outer surface with facial features of a character, such as a human being. The flexible mask is movable from a first position, at least partially covering the facial features of the head wherein the facial characteristics of the mask are exposed, and a second position wherein the latex mask is folded about the neck, and exposes the second facial characteristic.

DESCRIPTION OF THE EMBODIMENT

Figure 1:
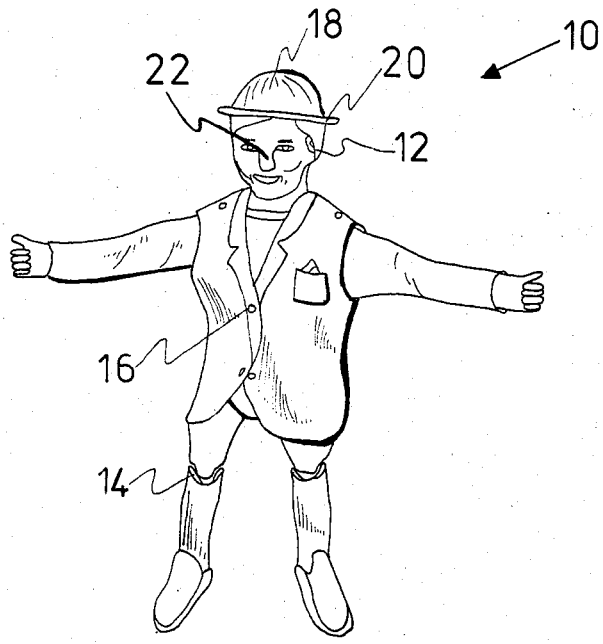
FIG. 1 is a perspective view of a toy action figure embodying the invention.
Figure 2:
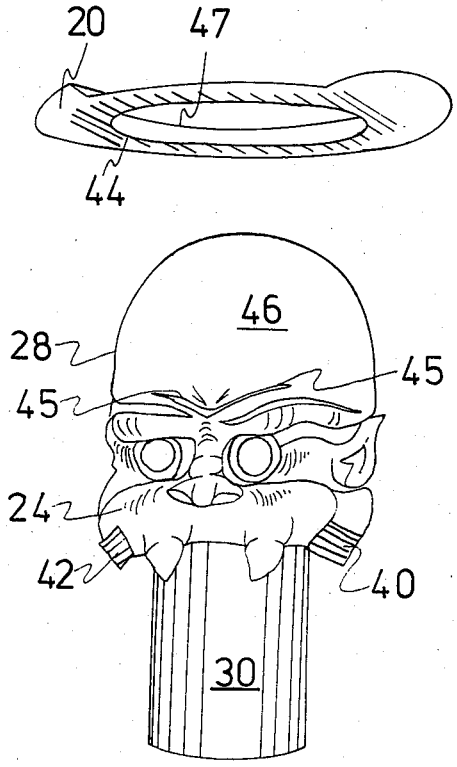
FIG. 2 is a perspective view of the figure after it has been transformed to another character.
Figure 2:
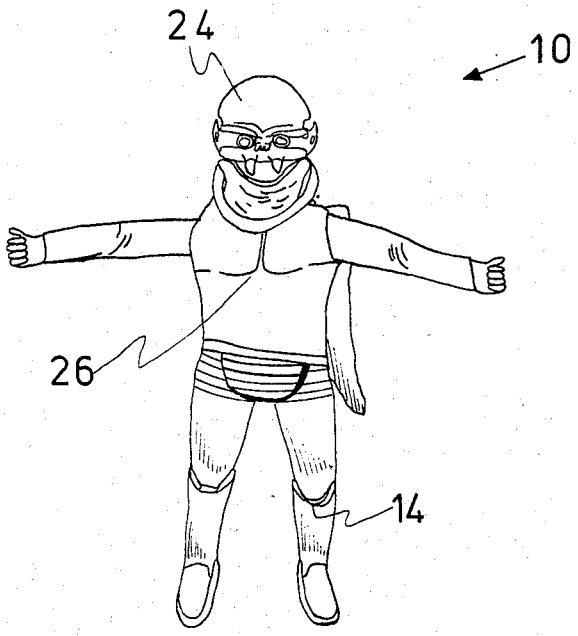

Referring now to the drawings in general, and in particular to FIGS. 1 and 2, there is shown a toy action figure, designated generally by the numeral 10, which embodies the principles of the present invention. The FIG. 10 includes a head, generally designated 12, and a body 14. Clothes 16 are positioned on the body 14 and may be reversible or removable. The clothes 16 may also be used to hide parts of the body which would be compatible with one character, but not another.

Figure 4:
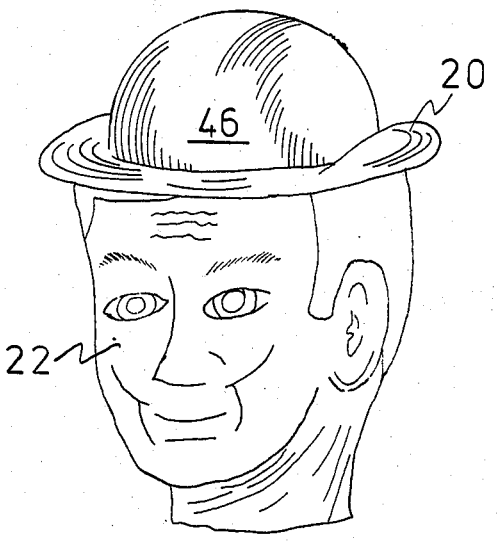
FIG. 4 shows the figure with the flexible mask portion positioned to display a character with facial expressions of a human being.
Figure 6:
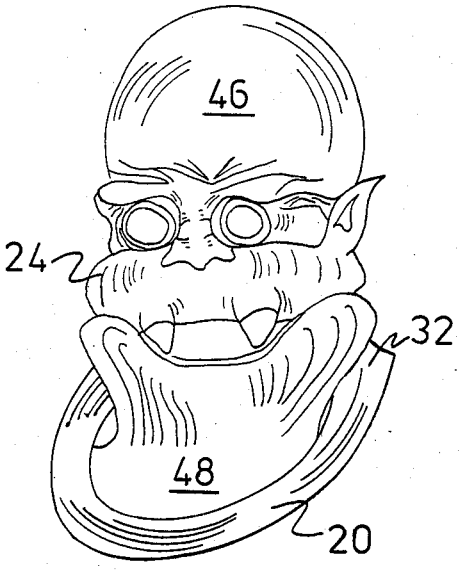
FIG. 6 is a view showing the flexible mask totally pulled to a second position to totally expose another facial characteristic.

When arranged as shown in FIGS. 1 and 4, the action FIG. 10 will have a facial expression of a first character 22, such as a human being. When arranged as shown in FIGS. 2 and 6, the action figure will display second facial features, such as a monster.

Referring now to FIG. 2 of the drawing, head 12 of action FIG. 10 displays a facial expression of a second character 24, which in the configuration shown, resembles that of a monster. After transforming the head into the monster configuration as will be described more fully hereinafter, the child may also reverse or remove the clothes 16 to expose monster clothes. The clothes 16 may be repositioned on the toy action figure as shown, or reversed, depending on which character is exposed.

Figure 3:
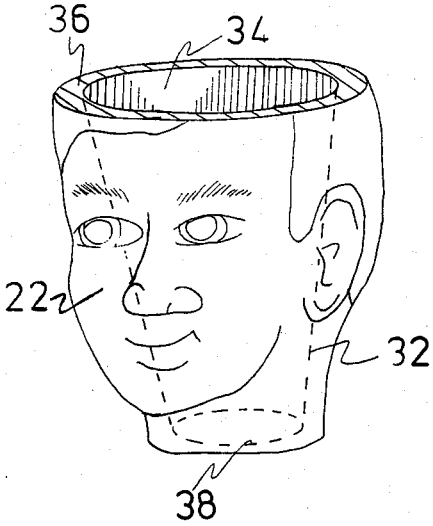
FIG. 3 is an exploded view of three parts which comprise the transformable head portion of the transformable figure.

Referring now to FIG. 3 of the drawing there is shown an exploded view of the transformable head of the invention. It comprises hard molded head member 28 formed of latex or other suitable material which is fixedly attached to a base 30 formed as a hard solid cylindrical shape. The base 30 is designed for positioning into a mating hole formed on the body (not shown). The hard molded head portion 28 has a facial characteristic of a second character 24, such as a monster.

Flexible mask 32 is formed with a hollow center portion 34 which is positionable around the hard molded head 12. It contains a flat top surface 36. The flexible mask 32 also contains an inner bottom surface 38 which is adhesively secured to a flat surface 40 and 42 contained on the hard molded head portion 28. When so positioned it can be seen that the flexible mask 32 covers up the face 24, on head portion 28. Outer surface 33 of mask 32 defines the first face 22 of the action figure.

In the illustrated embodiment, a hard plastic simulated hat brim 20 is adhesively attached to the flat top surface 36 in the area shown by the numeral 44. When attached in this manner, the hat brim 20 is positioned above the eyebrows 45 of the second character face 24 and the forehead 46 of the face 24 of the second character makes the doll's head appear to have a hat positioned on the head as shown in FIG. 1 of the drawing.

The hard plastic hat brim 20 forms a means for moving the mask from its first, to its second position, to transform the head of the doll from the first character, to the second character. Pulling the simulated hat brim 20 upward brings flexible mask 32 over head portion 28 thereby hiding the first character and exposing the features of the second character which are on the external surface of the mask. Reversal of this process, namely moving the brim 20 downward to the position around the neck, folds the mask 20 upon itself to conceal the facial features of the mask and reveal the facial features of the head portion 28. It should be appreciated that any suitable means may be employed to perform the transformation. For example, the top surface 36, without a hat brim would serve the purpose.

Figure 5:
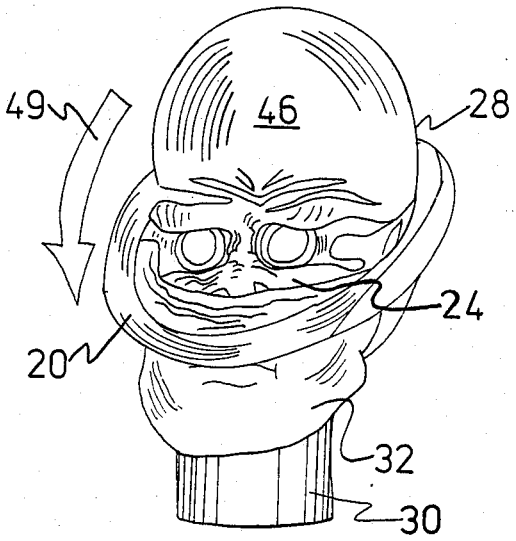
FIG. 5 shows the flexible mask partially removed from the position of FIG. 4 to expose a second character having facial expressions of a monster.
Figure 8:
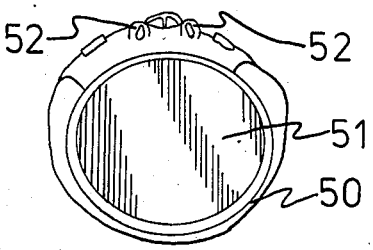
Figure 7:
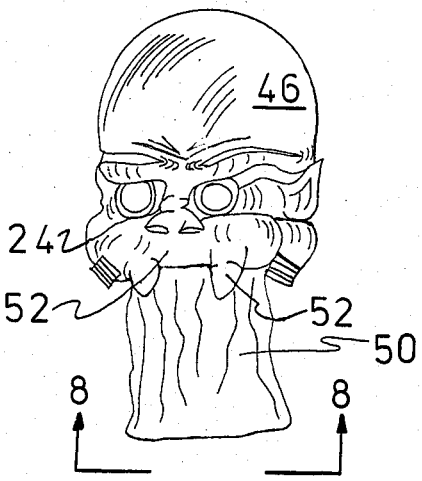

The transformation process can be appreciated by referring to FIGS. 4, 5 and 6 of the drawing. In FIG. 4, the doll's head has the mask in the first position with the first facial characteristic 22 of a human being having the simulated hat brim 20 in position at the forehead of head portion 28. As can be seen in FIG. 4 the portion which defines forehead 46 of the monster character 24 protrudes through the opening 47 of the hard plastic simulated hat brim 20 and gives the appearance of a hat sitting on the top of the human's head.

Referring to FIG. 5, there is shown the beginning of the transformation sequence where the hat brim 20 has been pulled down over the monster's face 24 to turn the flexible mask 32 inside out. The arrow 49 shows how the hard plastic hat brim 20 is pulled downwardly in the direction shown by the arrow to transform the doll's head from a first character of a human being to a second character of a monster.

The completed transformation is shown in FIG. 6 of the drawing where the mask is in the second position, It can be seen how the hard plastic hat brim 20 has been pulled down below the monster's head to conceal the outer surface flexible mask. Since the flexible mask had previously been adhesively secured by its inner bottom surface 38 to the flat surfaces 40 and 42 on the monster face, the inside 48 of the flexible mask helps to form a facial feature resembling a monster creature. The inner surface 48 of the flexible mask may also be colored to match the horrible visage of the monster to further enhance the monster's appearance. The brim 20 also becomes a collar about the monster's neck, rather than a hat brim.

Whenever the child wishes to re-transform the monster to a human appearance, the process is simply reversed and the flexible mask 32 pulled upward over the monster's head to give the doll the appearance of a human being as shown in FIG. 4 of the drawing.

The applicant's novel transformable doll may be constructed with various facial characteristics in other forms than a human being and a monster within the spirit and scope of the invention. The transformation of the doll's body may also be augmented by a reversal of the doll's clothes or a removal of the doll's clothes to expose a different set of clothes formed integrally with the body.

It will be apparent to those skilled in the art that various additions, subtractions, modifications, and omissions may be made to the construction of the present invention without departing from the spirit or scope of the invention.

Thus, it is intended that the present invention cover the additions, subtractions, modifications and omissions of this invention which come within the permissible scope of the appended claims.

We claim:

1. A doll, having a head transformable from display of a first character to display of a second character, comprising a body, a head, fixedly attached to the body, the head having facial characteristics of the second character; a flexible mask, contained on said head portion and defining a hollow tubular center portion having two open ends, said mask positioned around said head, said mask having facial characteristics of the first character formed on the exterior thereof, said mask being movable from first position on said head at least partially covering the facial characteristics on said head and exposing the facial characteristics on said mask, to a second position on said head where both said ends of said mask are located between the head and body portions exposing said facial characteristics on said head and at least partially concealing the facial characteristics on said exterior of said mask.

2. The doll as defined in claim 1 wherein the flexible mask includes a top surface defining an opening and is disposed with a portion of said head protruding therefrom and an inner bottom portion fixedly attached to the head at a lower portion of the head and said mask is folded upon itself when in said second portion to cause an additional portion of said head to protrude from said opening.

3. The doll as defined in claim 1 wherein flange means are secured to said opening defining top surface on said mask for moving said mask between said first and second positions.

4. The doll as defined in claim 3 wherein the facial characteristics of the first character are those of a human while the facial characteristics of the second character are those of a monster and said means for moving said mask is a simulated hat brim formed on said mask.

5. The doll as defined in claim 4 further comprising the body having positioned thereon clothes which are also movable between first and second positions.

6. The doll as defined in claim 5 comprising the body having formed on a portion thereof clothes which are characteristic of the second character and further comprising the body having positioned thereon removable clothes which are characteristic of the first character and cover the clothes of the second character.

7. The doll as defined in claim 1 wherein the flexible mask is formed of latex.

8. A head for a doll, the head being transformable from a first character to a second character, comprising:

a head portion with facial characteristics thereon of a second character, a flexible mask contained on said head portion and defining a hollow tubular center portion having two open ends, said mask positioned around said head, said mask having facial characteristics of the first character formed on the exterior thereof, said mask being movable from first position on said head at least partially covering the facial characteristics on said head and exposing the facial characteristics on said exterior of said mask, to a second position on said head where both said ends are located adjacent each other at one end of the head exposing said facial characteristics on said head and at least partially concealing the facial characteristics on said exterior of said mask.

9. The transformable head as defined in claim 8 wherein the head portion has a base designed to be positioned in and fixedly attached to the body of a doll.

10. The transformable head as defined in claim 8 wherein the first character is formed with human facial characteristics.

11. The transformable head as defined in claim 8 wherein the second character is formed with monster facial characteristics.

12. The transformable head as defined in claim 11 wherein the first character is formed with human facial characteristics.

13. The doll as defined in claim 8 wherein the flexible mask includes a top surface defining an opening and is disposed with a portion of said head protruding therefrom and an inner bottom portion fixedly attached to the the head at a lower portion of the head and said mask is folded upon itself when in said second portion to cause an additional portion of said head to protrude from said opening.

14. The doll as defined in claim 13 wherein flange means are secured to said opening defining top surface on said mask for moving said mask between said first and second positions.

15. The doll as defined in claim 14 wherein the facial characteristics of the first character are those of a human while the facial characteristics of the second character are those of a monster and said means for moving said mask is a simulated hat brim formed on said mask.

* * * * *